US011543775B2

(12) United States Patent
Le Bris

(10) Patent No.: US 11,543,775 B2
(45) Date of Patent: Jan. 3, 2023

(54) DRIVE MEMBER FOR A TIMEPIECE

(71) Applicant: PATEK PHILIPPE SA GENEVE, Geneva (CH)

(72) Inventor: Jean-Baptiste Le Bris, Marignier (FR)

(73) Assignee: PATEK PHILIPPE SA GENEVE, Geneva (CH)

( * ) Notice: Subject to any disclaimer, the term of this patent is extended or adjusted under 35 U.S.C. 154(b) by 770 days.

(21) Appl. No.: 16/483,592

(22) PCT Filed: Feb. 12, 2018

(86) PCT No.: PCT/IB2018/050834
§ 371 (c)(1),
(2) Date: Aug. 5, 2019

(87) PCT Pub. No.: WO2018/146639
PCT Pub. Date: Aug. 16, 2018

(65) Prior Publication Data

US 2020/0004202 A1 Jan. 2, 2020

(30) Foreign Application Priority Data

Feb. 13, 2017 (EP) ..... 17155883

(51) Int. Cl.

| | |
|---|---|
| ***G04B 1/18*** | (2006.01) |
| ***G04B 1/12*** | (2006.01) |
| ***G04B 1/14*** | (2006.01) |
| ***G04B 17/04*** | (2006.01) |

(52) U.S. Cl.
CPC ..... *G04B 1/18* (2013.01); *G04B 1/12* (2013.01); *G04B 1/14* (2013.01); *G04B 17/04* (2013.01)

(58) Field of Classification Search
CPC ... G04B 1/18; G04B 1/12; G04B 1/14; G04B 17/04
See application file for complete search history.

(56) References Cited

U.S. PATENT DOCUMENTS

| | | | | |
|---|---|---|---|---|
| 7,950,846 | B2 * | 5/2011 | Hessler | G04B 17/20 368/127 |
| 8,668,378 | B2 * | 3/2014 | Pellet | G04B 17/06 368/127 |
| 9,429,916 | B2 * | 8/2016 | Born | G04B 17/32 |
| 9,459,589 | B2 * | 10/2016 | Bühler | G04B 17/066 |
| 2011/0222377 | A1 * | 9/2011 | Ching | G04B 17/222 368/175 |

(Continued)

FOREIGN PATENT DOCUMENTS

| | | |
|---|---|---|
| CH | 343897 A | 12/1959 |
| CH | 699 988 | 5/2010 |

(Continued)

OTHER PUBLICATIONS

Machine Translation of EP2466393 (Year: 2022).*

(Continued)

*Primary Examiner* — Edwin A. Leon
*Assistant Examiner* — Jason M Collins
(74) *Attorney, Agent, or Firm* — Nixon & Vanderhye

(57) ABSTRACT

A drive member and a mechanism for a timepiece including such a drive member includes at least two monolithic units stacked and connected in series, each of these units including a hub and a rim which are connected by at least one elastic arm.

19 Claims, 7 Drawing Sheets

(56) References Cited

U.S. PATENT DOCUMENTS

| | | | |
|---|---|---|---|
| 2012/0120775 | A1 | 5/2012 | Avril et al. |
| 2016/0091862 | A1 | 3/2016 | Born et al. |
| 2016/0306324 | A1* | 10/2016 | Sarchi ..... G04B 17/063 |

FOREIGN PATENT DOCUMENTS

| | | | |
|---|---|---|---|
| CH | 703464 | A2 | 1/2012 |
| CH | 704147 | A2 | 5/2012 |
| CH | 706274 | A2 | 9/2013 |
| CH | 706924 | A2 | 3/2014 |
| CH | 707171 | A2 | 5/2014 |
| CH | 709914 | A2 | 1/2016 |
| CH | 710662 | A1 | 7/2016 |
| EP | 0649075 | B1 | 1/1997 |
| EP | 2105806 | A1 | 9/2009 |
| EP | 2273323 | A2 | 1/2011 |
| EP | 2 455 820 | | 5/2012 |
| EP | 2 466 393 | | 6/2012 |
| EP | 2801868 | A2 | 11/2014 |
| EP | 3 001 257 | | 3/2016 |
| JP | H09-089084 | A | 3/1997 |
| JP | 2012-510616 | A | 5/2012 |
| WO | 99/64936 | A1 | 12/1999 |
| WO | 2009/060074 | A1 | 5/2009 |

OTHER PUBLICATIONS

Chia-Wen Hou and Chao-Chieh Lan, "Functional joint mechanisms with constant-torque outputs," Mechanism and Machine Theory 62 (2013) 166-181.

Chao-Chieh Lan and Jung-Yuan Wang, "Design of Adjustable Constant-force Forceps for Robot-Assisted Surgical Manipulation," 2011 IEEE International Conference on Robotics and Automation, May 9-13, 2011, Shanghai, China, pp. 386-391.

Office Action issued in Japanese Patent Application No. 2019-543325 dated Dec. 8, 2021.

International Search Report, PCT/IB2018/050834, dated Jun. 8, 2018.

* cited by examiner

DRIVE MEMBER FOR A TIMEPIECE

BACKGROUND OF THE INVENTION

Field of the Invention

The present invention relates to a drive member for a timepiece, in particular a drive member with a substantially constant moment of force.

The drive member for a timepiece in accordance with the invention can be either a drive member of a timepiece movement arranged to drive a going gear train, or a drive member of an additional mechanism such as a striking mechanism or a chronograph mechanism.

Description of the Related Art

In horology, a barrel has traditionally been used as a drive member for a timepiece mechanism. A barrel is an assembly of at least three elements: a barrel spring consisting of a spiral spring leaf, a barrel drum serving as a housing for said spring, said drum being able to turn freely on a barrel arbor (pivoting axle between a bridge and a plate), and a barrel cover to close the barrel drum, said cover also being able to turn freely on the barrel arbor. Outside the barrel drum, the spring leaf is in the form of an inverted S. The unwinding of the leaf, wound against the diameter of the core of the barrel arbor and trying to resume its initial shape, produces the energy required for operation of the timepiece mechanism.

One disadvantage of such a drive member is that its yield is affected by the turns of the spiral spring rubbing against each other and against the inside of the barrel drum as the barrel is unwinding. In order to attenuate this rubbing it is normal practice to lubricate the turns of the spring and to deposit an anti-friction coating in the drum. In spite of this, such a drive member undergoes energy losses of about 15% owing to the rubbing.

Another disadvantage of such a drive member is that the manufacture and shaping of the spring leaf which it contains, from its inverted S shape to its spiral shape, must make large allowances for the elastic limit of the material from which the spring leaf is made. Moreover, the placement of the spiral spring housed in the barrel drum is dependent on years of experience of the clockmaker and requires numerous operating steps. Furthermore, it is an assembly of several elements.

Such a drive member is thus expensive and difficult to manufacture.

Furthermore, the moment of force output by such a drive member is not constant, which affects the isochronism of the timepiece mechanism. In order to attenuate this problem some timepiece movements use a spiral-type intermediate spring between the drive member and the escapement. One disadvantage of this solution is that it makes the movement more complex by introducing an additional element.

BRIEF SUMMARY OF THE INVENTION

The aim of the present invention is to provide an alternative drive member to the barrel comprising a traditionally used spiral spring which makes it possible to overcome, at least in part, the above-mentioned disadvantages.

To this end, the invention proposes a drive member for a timepiece comprising at least two monolithic units stacked and connected in series, each of these units comprising a hub and a rim which are connected by at least one elastic arm.

The present invention also proposes a timepiece mechanism comprising such a drive member for a timepiece.

The drive member in accordance with the invention has the advantage of clearly improving the yield (average energy loss between only 0 and 3% as opposed to about 15% for a traditional barrel with a spiral spring). Indeed, the monolithic units of which it is composed undergo very little or no rubbing.

Furthermore, when it comprises elastic arms of suitable shape, the drive member in accordance with the invention also has the advantage of outputting a substantially constant moment of force, thus improving the isochronism of the timepiece movement with which it is associated, without requiring an intermediate spring between the drive member and the escapement.

BRIEF DESCRIPTION OF THE DRAWINGS

Other features and advantages of the present invention will become clear upon reading the following detailed description given with reference to the attached drawings in which.

DETAILED DESCRIPTION OF THE PREFERRED EMBODIMENTS

Figure 1:
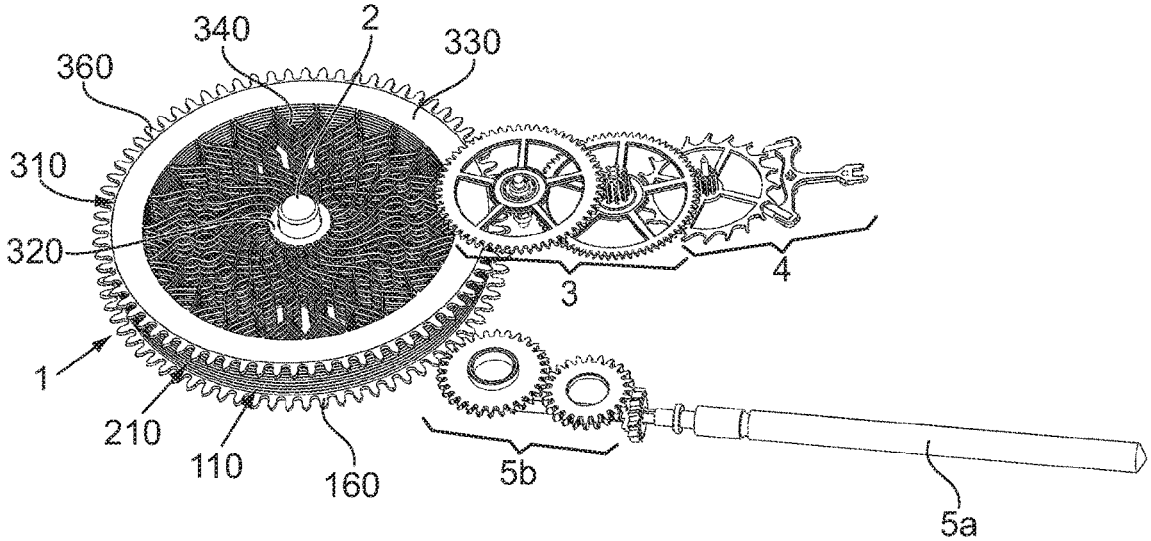
FIG. 1 is a perspective view of a part of a timepiece mechanism incorporating a drive member for a timepiece in accordance with one particular embodiment of the invention.
Figure 2:
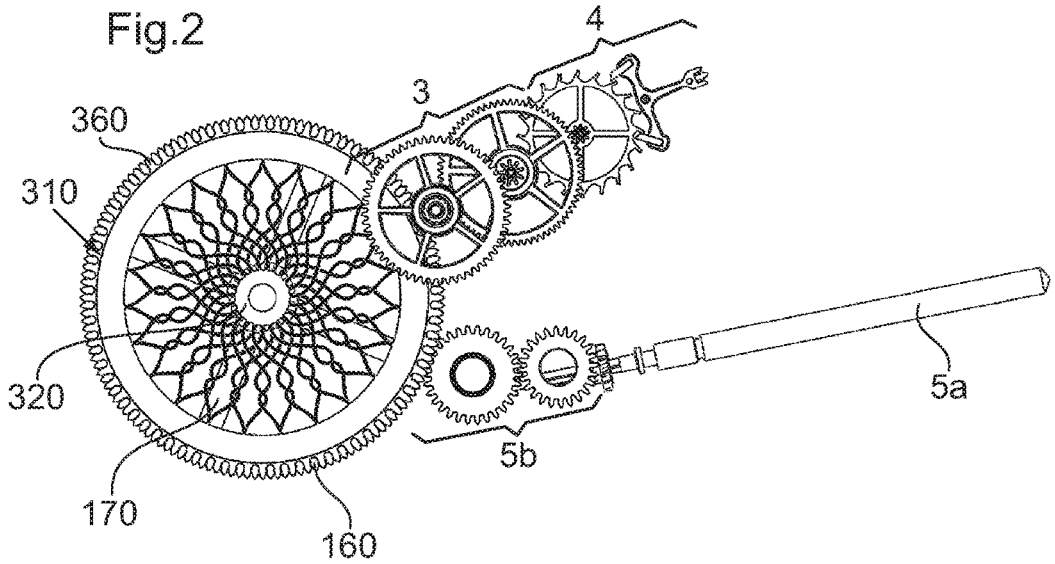
FIG. 2 is a view from above of the mechanism illustrated in FIG. 1.

FIGS. 1 and 2 illustrate a part of a timepiece mechanism, more precisely of a timepiece movement, comprising a drive member 1 for a timepiece according to one particular embodiment of the invention, this drive member 1 being held in position by means of an axle 2 of said timepiece movement. This timepiece movement further comprises in particular a going gear train 3, an escapement 4 and a winding mechanism 5*a*, 5*b* as illustrated in FIGS. 1 and 2. In the illustrated example, the winding mechanism comprises a winding shaft 5*a* and a winding gear train 5*b*. In one variation, it could be of the automatic type, with an oscillating weight.

Figure 3:
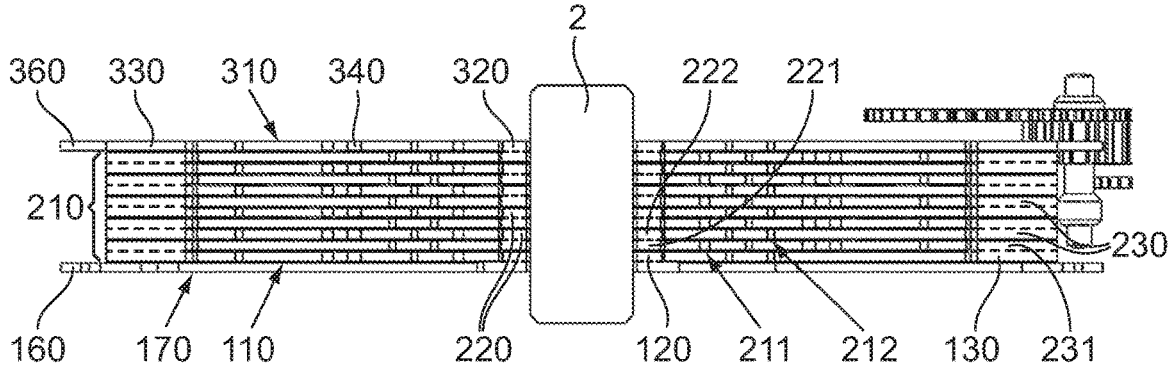
FIG. 3 is a cross-sectional view of the drive member of FIG. 1.
Figure 4A:
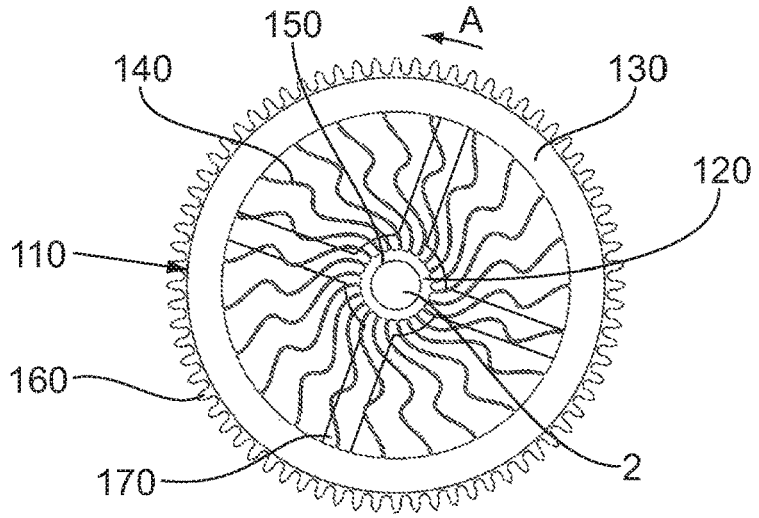
FIGS. 4*a*, 4*b* and 4*c* respectively illustrate, in a view from above, a first unit, an intermediate unit and a final unit of the drive member of FIG. 1.

The drive member 1 comprises a plurality of monolithic units 110, 210, 310, stacked one on top of the others and connected in series as illustrated in FIG. 3. Each of these units 110, 210, 310 comprises a hub 120, 220, 320 and a rim 130, 230, 330 which are connected by a plurality of elastic arms 140, 240, 340 uniformly distributed about its hub 120, 220, 320, as illustrated in FIGS. 4*a*, 4*b* and 4*c*.

The first 110 of said units is associated with a toothing 160 permitting connection to the winding gear train 5*b*. This toothing 160 which meshes with the winding gear train 5*b* is typically borne by a winding wheel 170 coaxial with, and fixed relative to, the hub 120 of said first unit 110, as illustrated in FIGS. 1, 2, 3 and 4*a*. Alternatively, the toothing 160 can be fixed relative to the rim 130 of the first unit 110. The one of the hub 120 or the rim 130 of the first unit 110 which is fixed relative to the toothing 160, and thus via which energy is input, constitutes an input element of the stack of units 110, 210, 310.

The last 310 of said units is associated with another toothing 360 which meshes with the going gear train 3 in order to impart a moment of force thereto. This other toothing 360 is typically fixed relative to the rim 330 of this final unit 310, as illustrated in FIGS. 1, 2, 3 and 4*c*. Alternatively, the toothing 360 can be fixed relative to the hub 320 of the last unit 310. The one of the hub 320 or the rim 330 of the last unit 310 which is fixed relative to said other toothing 360, and thus via which energy is output, constitutes an output element of the stack of units 110, 210, 310.

Figure 4B:
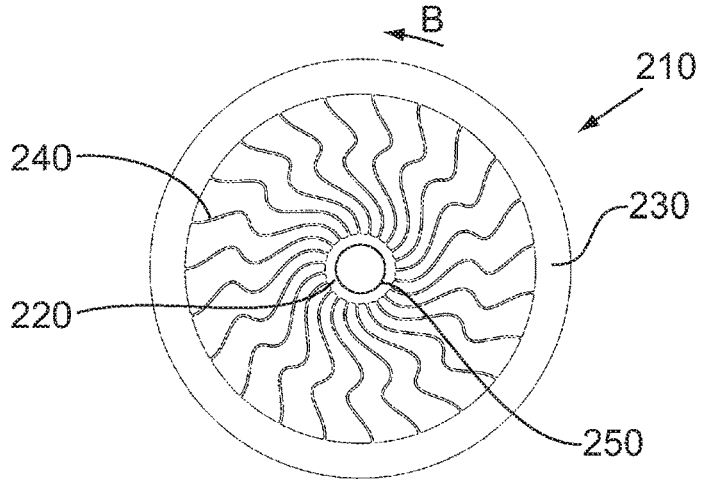
Figure 4C:
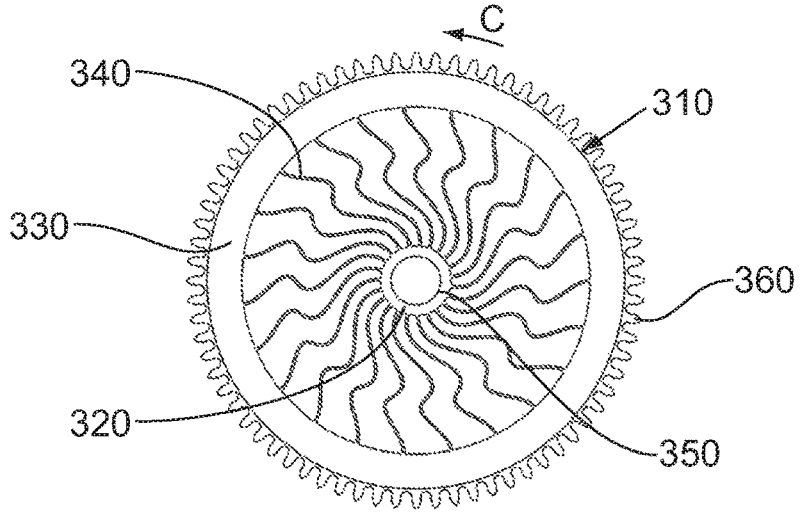

The intermediate units 210 placed between said first 110 and last 310 units are not associated with a toothing, as illustrated in FIGS. 1, 3 and 4*b*. Furthermore, each of the units 110, 210, 310 in accordance with the invention is unidirectional, i.e. it has, by reason of the shape of its elastic arms 140, 240, 340, a favoured direction of rotation of its rim 130, 230, 330 with respect to its hub 120, 220, 320, this direction being defined as that which permits, from the rest state of the unit in question, the greatest relative angular displacement of its rim 130, 230, 330 with respect to its hub 120, 220, 320. The arrows A, B and C, illustrated respectively in FIGS. 4*a*, 4*b* and 4*c*, illustrate this favoured direction of rotation of the rims 130, 230, 330 with respect to the hubs 120, 220, 320 for the illustrated units 110, 210, 310 of the drive member 1.

Preferably, all the units 110, 210, 310 (not including toothing) are identical (in particular, the arms 140, 240, 340 are of the same shape) and are stacked coaxially and in opposing directions, two successive units having opposing favoured directions of rotation. For example, when the drive member comprises three units 110, 210, 310, it can comprise a first unit 110 with its favoured direction of rotation in the clockwise direction (as shown in FIG. 4*a*), a single intermediate unit 210 with its favoured direction of rotation in the anti-clockwise direction (corresponding to a unit 210 as illustrated in FIG. 4*b* reversed) and a last unit 310 with its favoured direction of rotation in the clockwise direction (as illustrated in FIG. 4*c*).

As already indicated, the units 110, 210, 310 are also connected in series, these units 110, 210, 310 being alternately connected, in twos, by their rims 130, 230, 330 and by their hubs 120, 220, 320.

In the example of FIG. 3, the rim 130 of the first unit 110 is fixed relative to the rim 231 of the first intermediate unit 211, the hub 221 of this first intermediate unit 211 is fixed relative to the hub 222 of the second intermediate unit 212 and so on, the hub of the last intermediate unit being fixed relative to the hub 320 of the last unit 310.

The favoured direction of rotation of the first 110 and of the last 310 unit and the choice of input and output elements (rim or hub) depends on the position of the drive member 1 in the timepiece mechanism and depends on the winding mechanism 5*a*, 5*b* and on the going gear train 3. The favoured direction of rotation of the intermediate units 210 is decided according to the number thereof and according to the direction of the first 110 and last 310 units.

As illustrated in FIGS. 1 to 4*c*, the hubs 120, 220, 320 of the units 110, 210, 310 of the drive member 1 comprise piercings 150, 250, 350, e.g. circular piercings, these piercings 150, 250, 350 having the axle 2 of the timepiece movement passing through them, said axle 2 preferably being mounted in a fixed manner with respect to the movement, e.g. in the plate of the movement. This axle 2 positions the drive member 1 and assists in maintaining alignment of the hubs 120, 220, 320 of all the units 110, 210, 310, the hubs 120, 220, 320 being free to rotate about the axle 2.

Alternatively, the hubs 120, 220, 320 of the units 110, 210, 310 of the drive member 1 may not comprise piercings 150, 250, 350. The drive member can, in this case, be held in position e.g. by means of two axles mounted on the hubs 120, 320 respectively of the first 110 and last 310 units, these axles being respectively fixed in rotation relative to said hubs 120, 320 and free in rotation with respect to a fixed part of the movement, typically with respect to the plate. Furthermore, this drive member can be placed in a drum.

Figure 5A:
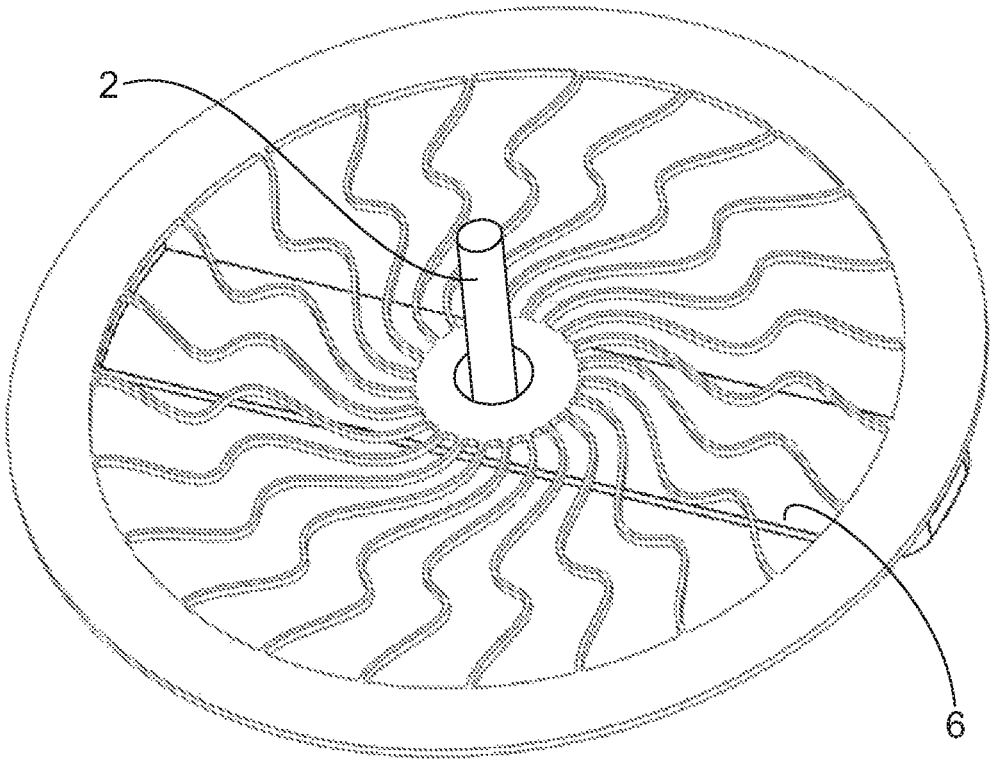
FIGS. 5*a* and 5*b* are respectively views from below and above of a unit of the drive member fitted with a centring device.
Figure 5B:
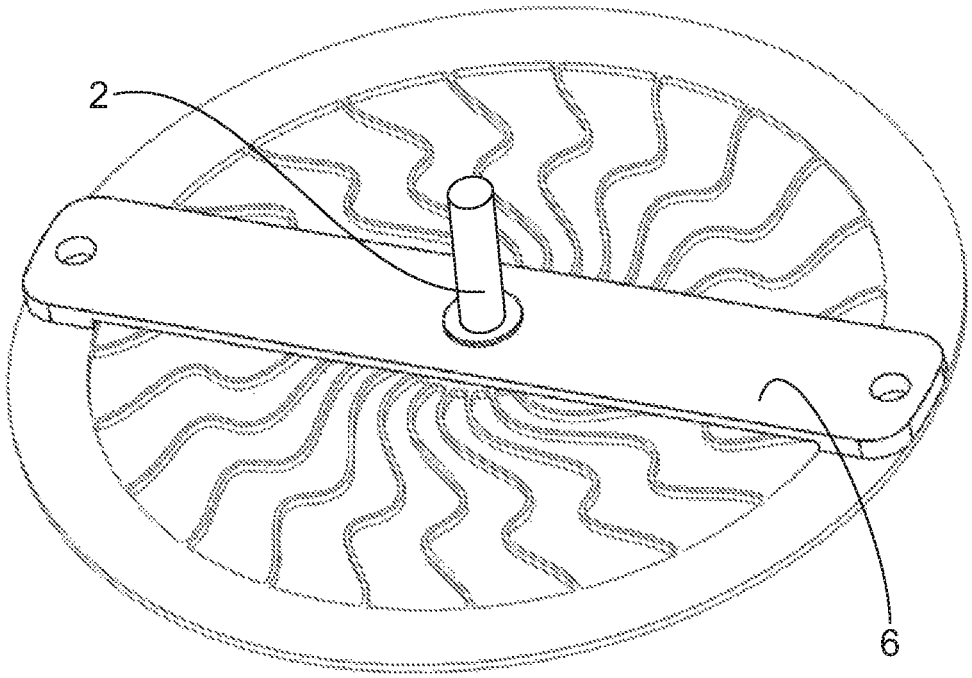

The actual structure of the drive member 1 implies centring of the hub 120, 220, 320 of each unit 110, 210, 310 with respect to its rim 130, 230, 330. However, the drive member 1 can comprise one or a plurality of devices for centring the hubs, aiming to reinforce the centring of the hubs 120, 220, 320. Such devices typically comprise a rigid joining element 6 on the one hand fixedly attached to two diametrically opposed zones of the rim 130, 230, 330 of a unit 110, 210, 310 and on the other hand positioned to rotate freely on the axle 2. FIGS. 5*a* and 5*b* are respectively views from below and above of a unit 110, 210, 310 of the drive member 1 fitted with such a centring device.

In general, all the elastic arms 140, 240, 340 of each unit 110, 210, 310 of the drive member 1 are designed, in particular in terms of their shape, to exert, in this unit 110, 210, 310, a substantially constant elastic return moment over a range of angular displacement of the rim 130, 230 330 of said unit 110, 210, 310 with respect to its hub 120, 220, 320 of at least 10°, preferably of at least 15°, e.g. of about 21°.

A "substantially constant" moment is understood to mean a moment varying by no more than 10%, preferably 5%, more preferably 3%, typically 1.5%, it being understood that this percentage can be reduced further.

More precisely, assuming that $M_{min}$ and $M_{max}$ are respectively the minimum and maximum moments exerted in a unit 110, 210, 310 of the drive member 1 over a given range of angular displacement of its rim 130, 230, 330 with respect to its hub 120, 220, 320, the moment exerted in this unit 110, 210, 310 is substantially constant when the inequation "$(M_{max}-M_{min})/((M_{max}+M_{min})/2)\leq 0.1$" is satisfied, more precisely when the inequation "$(M_{max}-M_{min})/((M_{max}+M_{min})/2)\leq y\ \%$", with y=10, preferably 5, more preferably 3, e.g. 1.5, is satisfied.

Figure 6:
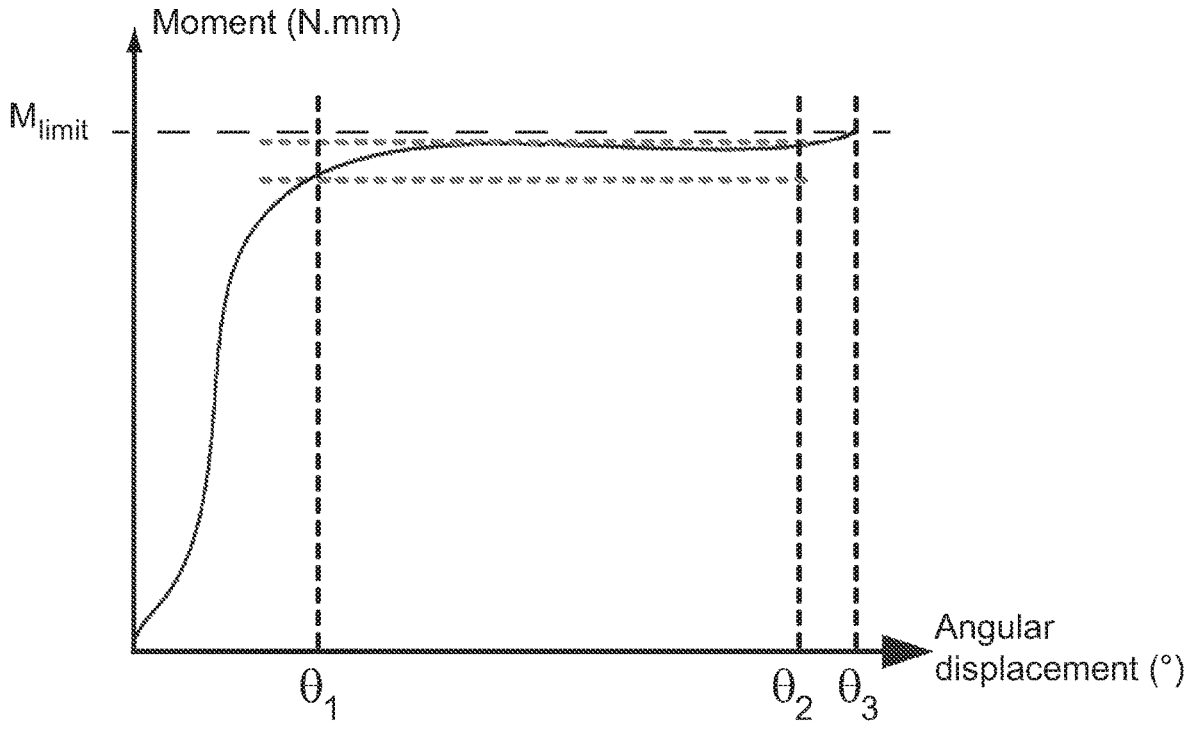
FIG. 6 is a schematic graphical illustration of the elastic return moment exerted in a unit of the drive member.

Assuming that 8 is the angular displacement of the rim 130, 230, 330 of a unit 110, 210, 310 of the drive member 1 with respect to the hub 120, 220, 320 of this same unit 110, 210, 310 in its favoured direction of rotation, θ being equal to zero when said unit 110, 210, 310 is at rest, i.e. when all its elastic arms 140, 240, 340 are at rest, FIG. 6 illustrates the evolution M(θ) of the elastic return moment exerted by all the elastic arms 140, 240, 340 of a unit 110, 210, 310 in this unit as a function of the angular displacement θ.

As shown in the curve M(θ) of FIG. 6, this elastic return moment follows an evolution in three phases:

- for an angle θ between 0 and a first value $\theta_1$, the elastic return moment increases rapidly with the angular displacement θ, this phase corresponds to the winding phase;
- beyond this first value $\theta_1$, the unit 110, 210, 310 is in a stable phase. Indeed, between this first value $\theta_1$ and a second value $\theta_2$, the elastic return moment is substantially constant with respect to the angular displacement θ;
- beyond this second value $\theta_2$, the elastic return moment increases again until it reaches a limit value $M_{limit}$, for an angular displacement $\theta=\theta_3$. This value $M_{limit}$ depends on properties of the material of which the unit 110, 210, 310 is produced and corresponds to the maximum strain to which a unit 110, 210, 310 may be subjected.

For a given monolithic unit it is possible to define limit values of angles $\theta_{min_y}$ and $\theta_{max_y\ \%}$ between which the elastic return moment is substantially constant, with a constancy of y %. For example, if it is desired to obtain constancy of the elastic return moment of 5%, the curve M(θ) is used to define the values of the angles $\theta_{min_5\%}$ and $\theta_{max_5\%}$ so that the inequation: "$(M_{max}-M_{min})/((M_{max}+M_{min})/2)<0.05$" is satisfied; with $M_{max}$ being the maximum elastic return moment over the interval of angles $[\theta_{min_5\%}, \theta_{max_5\%}]$ and $M_{min}$ being the minimum elastic return moment over this same interval.

The monolithic units 110, 210, 310 having a curve M(θ) of the type illustrated in FIG. 6 differ from the conventional elastic structures. Their properties are based on a sinuous shape of their elastic arms which deform so as to generate a substantially constant elastic return moment (the curve M(θ) has a plateau). Furthermore, by reason of their sinuous shape, the elastic arms 140, 240, 340 of a given unit 110, 210, 310 have the advantage that they can be relatively long without the risk of rubbing against each other during rotation of the rim 130, 230, 330 of said unit 110, 210, 310 with respect to its hub 120, 220, 320.

Such elastic arms require specific and parametrised design. They can be obtained e.g. by topological optimisation by application of the teaching of the publication "Design of adjustable constant-force forceps for robot-assisted surgical manipulation", Chao-Chieh Lan et al., 2011—*IEEE International Conference on robotics and automation*, Shanghai International Conference Center, May 9-13, China.

The topological optimisation in question in the above-mentioned article uses parametric polynomial curves such as Bézier curves in order to determine the geometric shape of the elastic arms.

The Bézier curves are defined jointly with a series of m=(n+1) control points ($Q_0$, $Q_1$, . . . $Q_n$) by a set of points the coordinates of which are given by sums of Bernstein polynomials weighted by the coordinates of said control points.

The geometric shape of each of the elastic arms 140, 240, 340 of the drive member 1 is a Bézier curve the control points of which have been optimised to take into account in particular the dimensions of the unit 110, 210, 310 to be designed as well as the desired stress "$(M_{max}-M_{min})/((M_{max}+M_{min})/2)\leq 0.05$". The inequation $(M_{max}-M_{min})/((M_{max}+M_{min})/2)\leq 0.05$" corresponds to a constancy of the elastic return moment of 5% over an angular range $[\theta_{min_5\%}, \theta_{max_5\%}]$.

More precisely, the geometric shape of each of the elastic arms 140, 240, 340 of the drive member 1 is defined by all the points $$\Sigma_{i=0}^{n} B_i^n(t)\cdot Q_i, \text{ with } t\in[0, 1],$$

wherein the $B_i^n$ are the Bernstein polynomials given by the function $$B_i(t) = \frac{(m-1)!}{i!(m-1-i)!} t^i (1-t)^{m-i-1} \text{ with } t \in [0, 1],$$

and wherein $Q_i$ are the control points $Q_0$ to $Q_n$. It corresponds to the graphical representation in an orthonormal mark of all the points defined by the coordinate pairs (x; y) defined respectively by the functions x(t) and y(t), t∈[0, 1], below:

$$x(t)=\Sigma_{i=0}^{m-1} Q_{ix} B_i(t)$$

$$y(t)=\Sigma_{i=0}^{m-1} Q_{iy} B_i(t)$$

in which $Q_{ix}$ and $Q_{iy}$ are respectively the x and y coordinates of the control points $Q_i$.

The formulae indicated above give the coordinates of a Bézier curve of order m, i.e. a Bézier curve based on m control points. For practical reasons, such a Bézier curve can be broken down into a succession of Bézier curves of order lower than m, in which case the geometric shape of each of the elastic arms is a succession of Bézier curves.

Using this principle, the applicant has designed a particular unit of a drive member, said particular unit comprising twenty three elastic arms distributed uniformly about the hub. The dimensions of this particular unit are as follows:

- outer diameter of the rim: 12 mm
- outer diameter of the hub: 2 mm
- inner diameter of the rim: 10 mm
- height 0.15 mm
- thickness of the elastic arms: 60 μm In the framework of this design, seven control points $Q_0$, $Q_1$, $Q_2$, $Q_3$, $Q_4$, $Q_5$, $Q_6$ have been used. The coordinates of these control points are indicated in Table 1 below.

TABLE 1

Coordinates of the control points $Q_0$ to $Q_6$.

| Variables | x coordinates [mm] | y coordinates [mm] |
|---|---|---|
| $Q_0$ | 0.756625 | 0.653875 |
| $Q_1$ | 1.87325 | 1.619 |
| $Q_2$ | 2.8125 | −0.59125 |
| $Q_3$ | 3.4375 | 0.4535 |
| $Q_4$ | 3.75 | 1.032875 |
| $Q_5$ | 4.375 | 0 |
| $Q_6$ | 5 | 0 |

With these seven control points it would have been possible to produce a Bézier curve of order seven. However, according to the principle indicated above, the Bézier curve has been broken down into two segments, a first segment corresponding to a Bézier curve of order 4 based on the control points $Q_0$ à $Q_3$ and a second segment corresponding to a Bézier curve of order 4 based on the control points $Q_3$ to $Q_6$.

Using the coordinates of the control points $Q_0$ to $Q_6$ above in the above-mentioned functions x(t) and y(t) the applicant has obtained the coordinates of the points defining the geometrical shape of an elastic arm of the particular unit. A certain number of these pairs of coordinates are given in Table 2 below.

TABLE 2

Coordinates of transition points of the optimised elastic arm

| x [mm] | y [mm] |
|---|---|
| 0.756625 | 0.653875 |
| 1.086132 | 0.854582 |
| 1.404044 | 0.903348 |
| 1.709407 | 0.838756 |
| 2.001267 | 0.699389 |
| 2.278672 | 0.523828 |
| 2.540668 | 0.350656 |
| 2.786302 | 0.218455 |
| 3.014621 | 0.165807 |
| 3.224671 | 0.231295 |
| 3.4155 | 0.4535 |
| 3.524275 | 0.58159 |
| 3.648736 | 0.628816 |
| 3.787142 | 0.611048 |
| 3.937748 | 0.544158 |
| 4.098813 | 0.444016 |
| 4.268592 | 0.326492 |
| 4.445344 | 0.207458 |
| 4.627324 | 0.102784 |
| 4.812791 | 0.028341 |
| 5 | 0 |

Figure 7:
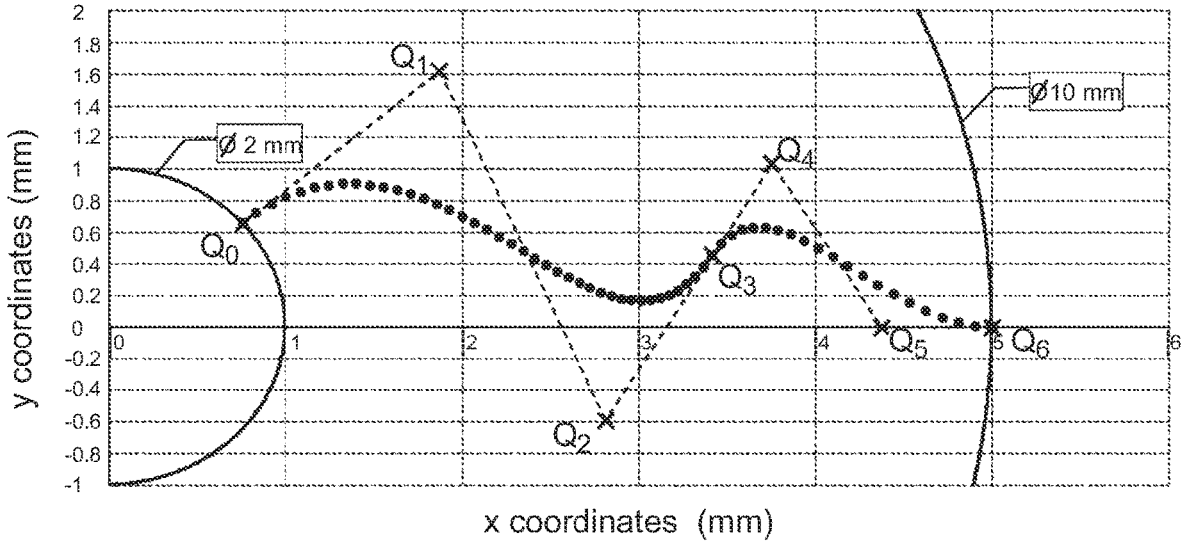
FIG. 7 illustrates the coordinates of points defining a particular shape of an elastic arm for each unit of the drive member.

The graph of FIG. 7 shows the geometry of the external diameter of the hub, of the internal diameter of the rim and of one of the elastic arms of the particular unit which the applicant has designed, the geometry of said arm being defined by a curve passing through all the coordinates of points defined in Table 2 above. This graph is produced in an orthonormal mark.

Figure 8A:
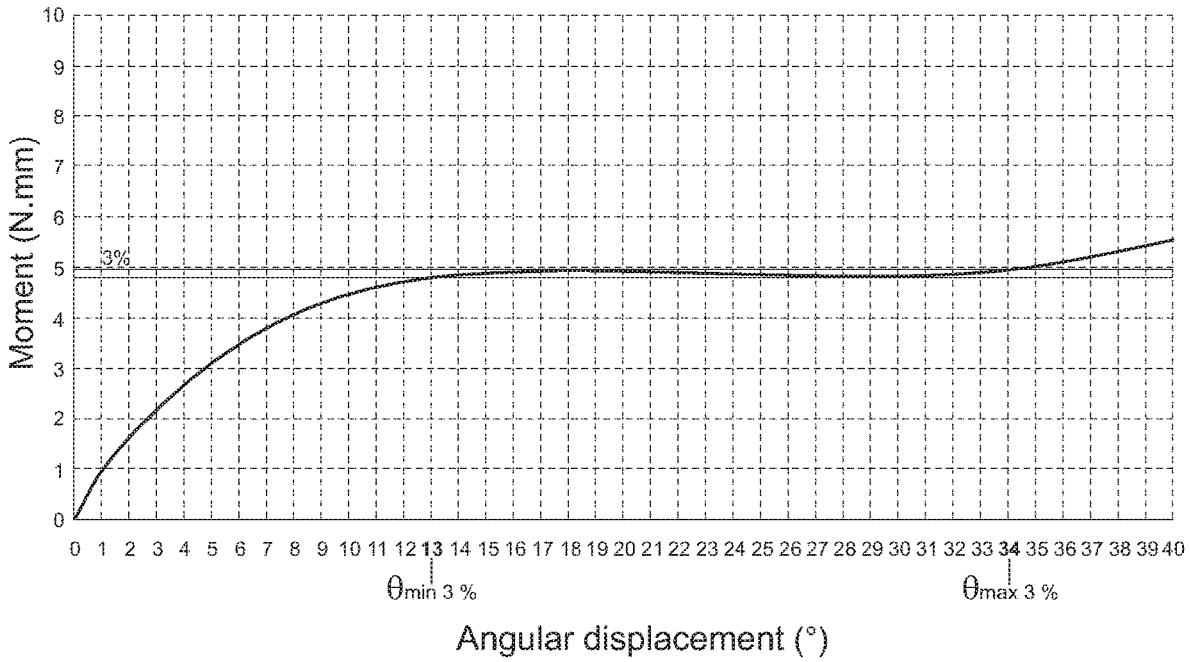
FIG. 8*a* is a graphical illustration of the elastic return moment exerted in a given unit of the drive member including elastic arms having the shape illustrated in FIG. 7.

FIG. 8*a* shows the results of a simulation of the evolution of the elastic return moment of the particular unit thus produced as a function of the angular displacement of its rim with respect to its hub.

The simulation effected considers a particular unit produced of a cobalt, nickel and chromium based alloy, more precisely of Nivaflex® 45/18 (Young's modulus E=220 GPa) but any suitable material can be used. For example, materials such as silicon (E=130 GPa), typically coated with silicon dioxide, metallic glass, plastic or CK101 (non-alloyed construction steel) are also suitable and make it possible to obtain monolithic units with a substantially constant elastic return moment over the same angular ranges $[\theta_{min}, \theta_{max}]$.

Since the angular range of operation permitting the outputting of a substantially constant moment is a constant linked to the shape of the elastic arms, it is important to take into account the ratio between the elastic limit and the Young's modulus of the material when choosing the material.

The analysis of the results presented in FIG. 8*a* shows that a constancy of 3% of the elastic return moment is obtained for an angular displacement of the rim of the particular unit analysed with respect to its hub between $\theta_{min_3\%}$, i.e. 13°, and $\theta_{max_3\%}$, i.e. 34°, i.e. over an operating range of 21°.

By increasing the number of control points when designing the elastic arms 140, 240, 340, it should be possible to increase the precision of the shape of these elastic arms and thus to improve the constancy of the moment of force.

A drive member 1 comprising eleven units identical to the particular unit analysed in FIG. 8*a*, which are stacked and connected in series, has also been designed. A simulation has made it possible to graphically illustrate the moment of force output by the rim 330 (output element) of the last unit 310 of this drive member 1 as a function of the angular displacement of the rim 330 of the last unit 310 with respect to the hub 120 (input element) of the first unit 110. The results of this simulation are shown in FIG. 8*b* (curve C2).

Figure 8B:
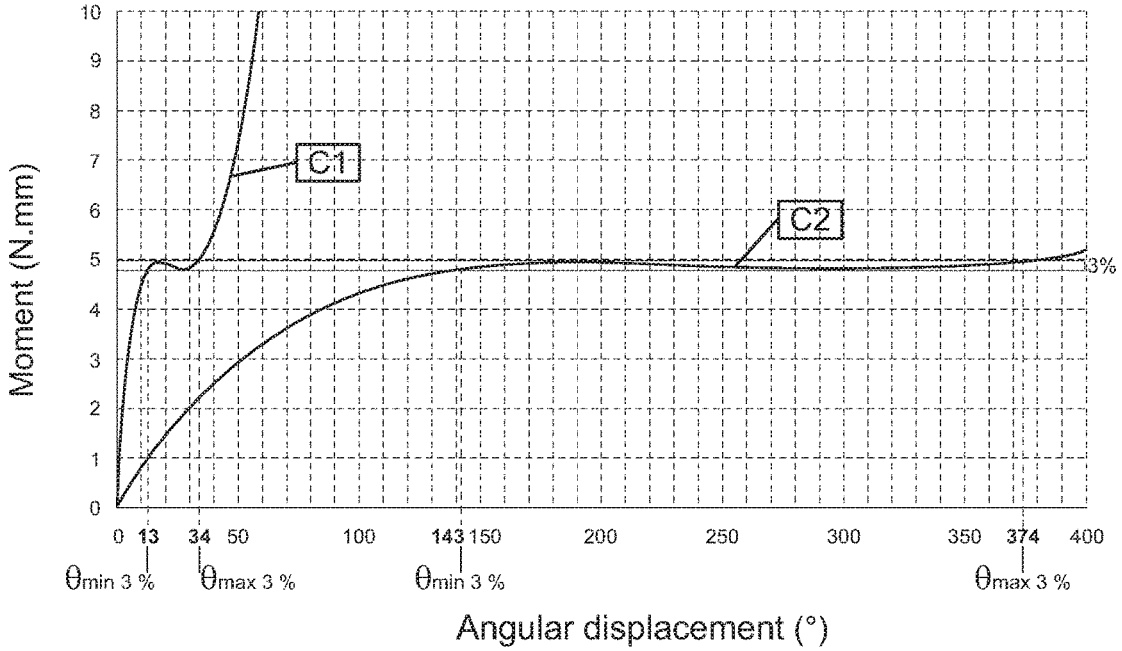
FIG. 8*b* is a graphical illustration of the moment of force output by a drive member including eleven units such as that analysed in FIG. 8*a*, which are stacked and connected in series.

FIG. 8*b* also illustrates the elastic return moment of a single particular unit identical to that analysed in FIG. 8*a* as a function of the angular displacement of its rim with respect to its hub (curve C1).

As can be seen in this FIG. 8*b*, the value of the moment of force exerted by the drive member 1 comprising eleven units, when it is in its stable phase, (about 5 N·mm) is unchanged with respect to the value of the elastic return moment exerted by all the elastic arms of an isolated monolithic unit, in this unit, in its stable phase. Each angle $\theta_{min_3\%}$ and $\theta_{max_3\%}$ for the drive member 1 is equal to eleven (i.e. the number of units placed in series) times the corresponding angle $\theta_{min_3\%}$ and $\theta_{max_3\%}$ for a unit. Indeed, $\theta_{min_3\%}$ and $\theta_{max_3\%}$ for eleven units are respectively 143° and 374°.

The arrangement of such units in series thus makes it possible to increase the amplitude of the angular displacement associated with the outputting of a substantially constant moment while preserving the intensity of this moment.

In general, the applicant has been able to find that a drive member 1 comprising p units 110, 210, 310, p being an integer greater than or equal to two, makes possible the outputting of a substantially constant moment of force over a range of angular displacement of the output element, rim 330 or hub 320, of its last unit 310 with respect to the input element, rim 130 or hub 120, of its first unit 110 of at least (p×10)°, preferably of at least (p×15)°, e.g. of about (p×21)°.

When p=2 the drive member 1 has no intermediate unit 210 but comprises only a first unit 110 and a last unit 310 stacked and connected by their respective rims or by their respective hubs.

Figure 10:
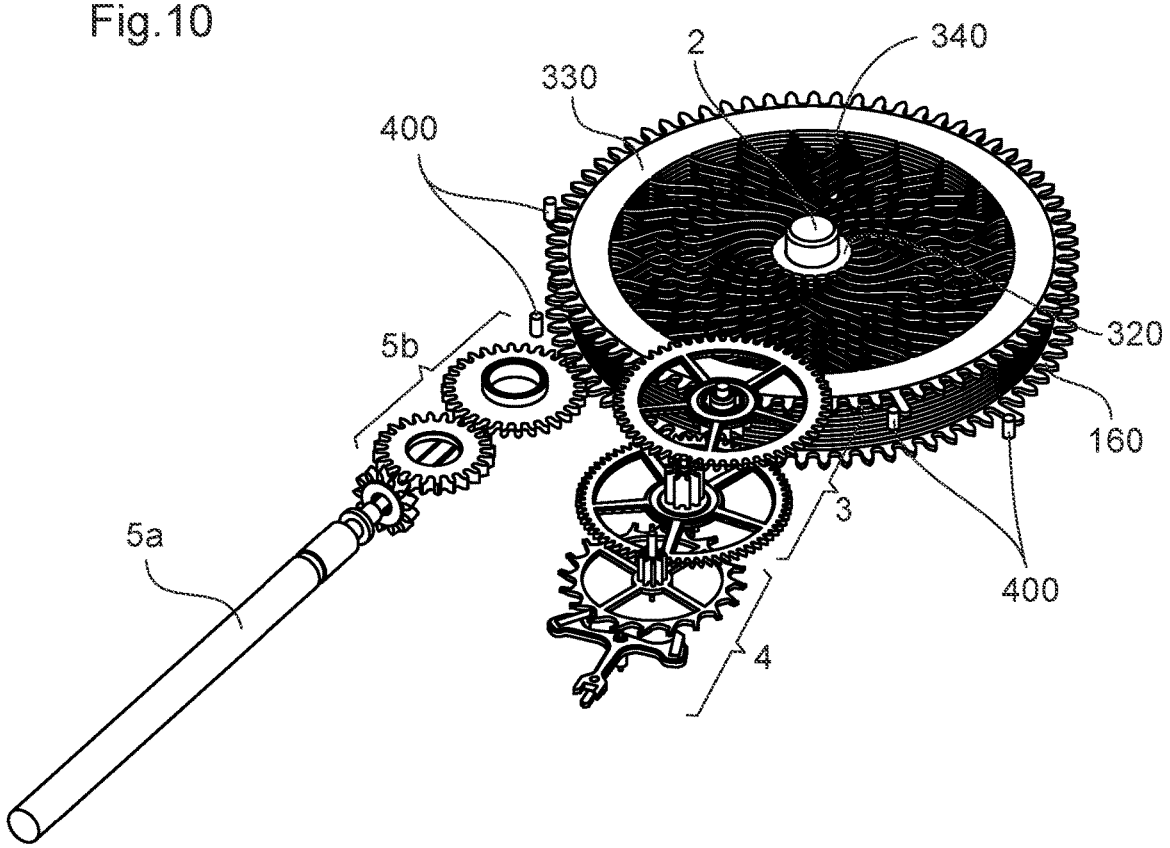
FIG. 10 is a perspective view of a part of a timepiece mechanism incorporating a drive member for a timepiece in accordance with one particular embodiment of the invention with stop devices.
Figure 11:
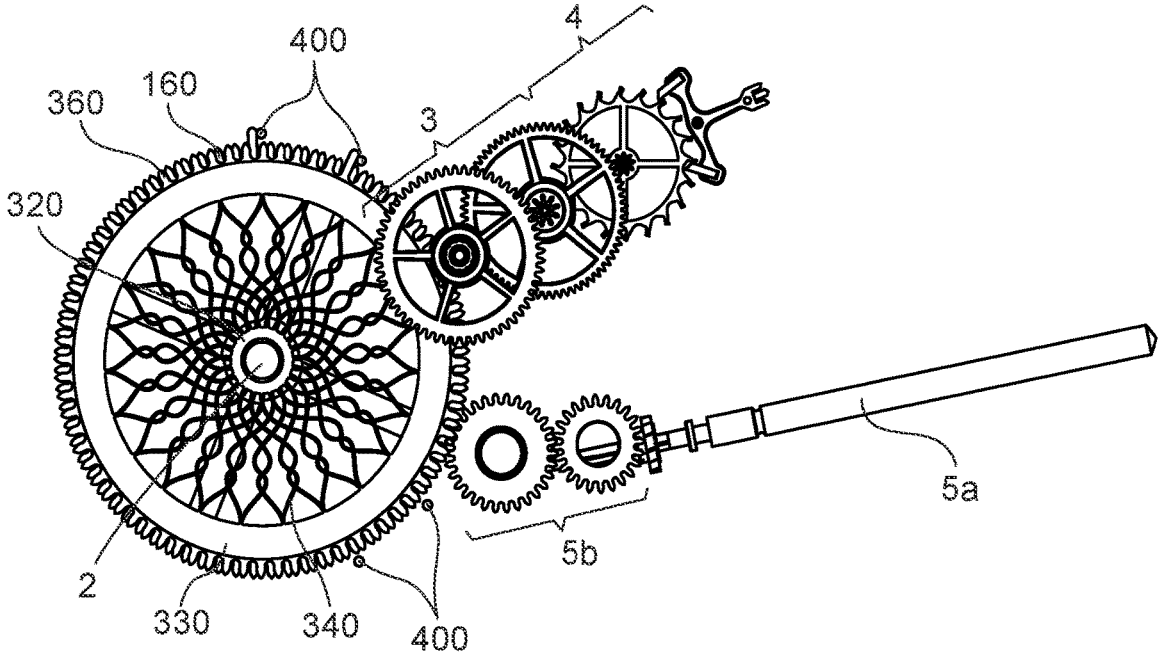
FIG. 11 is a view from above of the mechanism illustrated in FIG. 10.

In an advantageous manner, as illustrated in FIGS. 10 and 11, the timepiece mechanism incorporating the drive member 1 can comprise stop elements 400 making it possible to keep said drive member 1 within the range of angular displacement of the output element of its last unit 310 with respect to the input element of its first unit 110, permitting the outputting of a substantially constant moment of force.

As indicated above, the drive member 1 can be produced of any suitable material, in particular with respect to its elastic limit and its Young's modulus.

The units 110, 210, 310 can be produced separately and then fitted together. They can be produced e.g. by machining, in particular in the case where they are made of metal or of an alloy such as Nivaflex®, by DRIE etching in the case of e.g. silicon, or even by moulding, in particular in the case where they are produced of plastic or metallic glass. The units 110, 210, 310 obtained can then be fitted to each other, typically by gluing, welding or brazing.

Alternatively, the drive member 1 can be produced in a single monolithic piece, e.g. using 3D printing techniques or laser cutting techniques, typically of a mineral glass.

Advantageously, the coaxially stacked units 110, 210, 310 are arranged so that the elastic arms 140, 240, 340 of the units with the same favoured direction of rotation are aligned, which makes it possible to obtain an attractive aesthetic effect, as shown in FIGS. 1 and 2.

Alternatively, the drive member 1 can comprise monolithic units of a shape different from that illustrated in FIGS. 1, 2 and 4. In particular, they can be of a shape as illustrated in FIG. 9.

Figure 9:
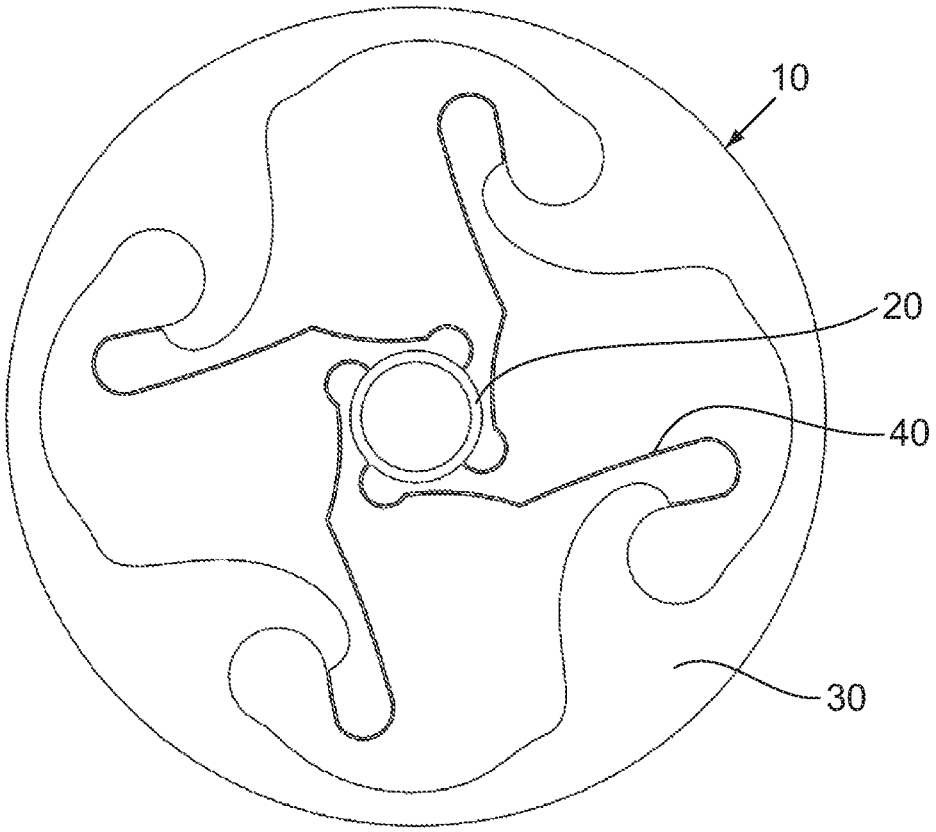
FIG. 9 illustrates, in a view from above, a variation of a unit of the drive member for a timepiece in accordance with the invention.

The monolithic unit 10 illustrated in FIG. 9 comprises elastic arms 40 exerting an elastic return moment which is substantially constant over a range of angular displacement of the rim 30 of said unit with respect to its hub 20 of at least 10°, preferably of at least 15°, e.g. of about 21°.

One means of obtaining such elastic arms 40 is in particular described in the article "Functional joint mechanisms with constant torque outputs", *Mechanism and machine theory* 62 (2013) 166-181, Chia-Wen Hou et al.

It will be clear to a person skilled in the art that the present invention is in no way limited to the embodiments presented above and illustrated in the figures.

For example, it is entirely possible to produce a drive member 1 comprising a number of monolithic units different from that illustrated in the figures and/or comprising units with elastic arms of shapes different from those illustrated in the figures and/or of which the number of elastic arms is different from that illustrated in the figures, a monolithic unit being able in particular to have only one elastic arm.

The value of the moment of force reached in the stable phase of the drive member can in particular be adjusted by varying the number of elastic arms comprised by the units of which it is made, the thickness of the elastic arms and/or the material used. In particular, in a monolithic unit comprising q elastic arms, q being an integer greater than or equal to 2, the moment of force exerted by all of these q elastic arms in the monolithic unit in its stable phase is typically equal to q times the moment of force exerted, in a similar monolithic unit comprising only one of these elastic arms, by said single elastic arm in this unit, in its stable phase.

The angular range $[\theta_{min}, \theta_{max}]$ over which the moment of force output is substantially constant can be regulated by adjusting the number of units stacked and connected in series.

It is also possible that at least one or each of the elastic arms of the units in accordance with the invention has a variable cross-section, e.g. a variable thickness. The cross-section could typically be greater towards the hub than towards the rim.

Furthermore, as already indicated, the toothing 360 associated with the last unit 310 of the drive member 1 in accordance with the invention can be chosen to be fixed relative to the hub 320 or to the rim 330 of this unit 310. In particular, it can be borne directly by said rim 330 or by said hub 320.

Similarly, the toothing 160 associated with the first unit 110 of the drive member 1 in accordance with the invention can be chosen to be fixed relative to the hub 120 or to the rim 130 of this unit 110. In particular, it can be borne directly by said rim 130 or by said hub 120.

Furthermore, the person skilled in the art can easily adjust, according to his requirements (i.e. for example according to the number of units comprised by the drive member 1, depending on whether the toothing 360 is fixed relative to the hub 320 or to the rim 330 of the last unit 310, depending on whether the toothing 160 is fixed relative to the hub 120 or to the rim 130 of the first unit 110, depending on the favoured direction of rotation chosen for any one of the units . . . ), the arrangement of the rim-rim and hub-hub connections of a drive member 1 in accordance with the invention.

Furthermore, the moment of force output by the drive member 1 can permit a type of gear train other than a going gear train 3 or an additional mechanism such as a striking or chronograph mechanism to be set in motion.

The invention claimed is:

1. A drive member for a timepiece, the drive member comprising:

at least two monolithic devices stacked and connected in series, each of the at least two monolithic devices comprising a hub, and a rim, and at least one elastic arm connecting the hub and the rim, wherein one or more of the at least one elastic arm of each of the at least two monolithic devices is of sinuous shape.

2. The drive member as claimed in claim 1, further comprising:

a first toothing configured to connect the at least two monolithic devices and a winding device; and a second toothing configured to output a moment of force by the at least two monolithic devices.

3. The drive member as claimed in claim 2, wherein the first toothing is fixed relative to the hub or the rim of a first one of the at least two monolithic devices.

4. The drive member as claimed in claim 3, wherein the second toothing is fixed relative to the hub or the rim of a last one of the at least two monolithic devices.

5. The drive member as claimed in claim 3, wherein the shape of the at least one elastic arm is the same for all of the at least two monolithic devices, and wherein the at least two monolithic devices are unidirectional and are disposed in twos in opposing directions.

6. The drive member as claimed in claim 2, wherein the second toothing is fixed relative to the hub or the rim of a last one of the at least two monolithic devices.

7. The drive member as claimed in claim 2, wherein the shape of the at least one elastic arm is the same for all of the at least two monolithic devices, and wherein the at least two monolithic devices are unidirectional and are disposed in twos in opposing directions.

8. The drive member as claimed in claim 1, wherein the shape of the at least one elastic arm is the same for all of the at least two monolithic devices, and wherein the at least two monolithic devices are unidirectional and are disposed in twos in opposing directions.

9. The drive member as claimed in claim 1, wherein the at least one elastic arm of each of the at least two monolithic devices comprises a plurality of elastic arms uniformly distributed around the respective hub.

10. The drive member as claimed in claim 1, further comprising at least one centering device configured to center the hubs.

11. The drive member as claimed in claim 1, wherein the at least one elastic arm of each of the at least two monolithic devices is configured to exert a substantially constant elastic return moment over a range of angular displacement of the rim of said respective monolithic device with respect to the respective hub of at least 10°.

12. The drive member as claimed in claim 1, wherein the at least two monolithic devices comprise p monolithic devices, p being an integer greater than or equal to two, and wherein the elastic arms of the at least two monolithic devices are configured so that the drive member outputs a substantially constant moment of force over a range of angular displacement of an output device, one of the rims or one of the hubs, of the stack of the at least two monolithic devices with respect to an input element, another one of the rims or another one of the hubs, of said stack of at least (p×10°).

13. The drive member as claimed in claim 1, wherein the geometric shape of one or more of the at least one elastic arm of any one of said at least two monolithic devices is a Bézier curve or a succession of Bézier curves.

14. A timepiece mechanism comprising:

the drive member as claimed in claim 1.

15. The timepiece mechanism as claimed in claim 14, further comprising an axle passing through the hubs of the at least two monolithic devices.

16. The timepiece mechanism as claimed in claim 14, further comprising a plurality of stop elements configured to keep the drive member within a range of angular displacement of an output element, one of the rims or one of the hubs, of the stack of the at least two monolithic devices with respect to an input element, another one of the rims or another one of the hubs, of said stack permitting outputting of a substantially constant moment of force.

17. The timepiece mechanism as claimed in claim 14, further comprising a winding mechanism configured to wind the drive member and a gear train configured to be driven by the drive member.

18. The drive member as claimed in claim 1, wherein the at least two monolithic devices comprise p monolithic devices, p being an integer greater than or equal to two, and wherein the elastic arms of the at least two monolithic devices are configured so that the drive member outputs a substantially constant moment of force over a range of angular displacement of an output device, one of the rims or one of the hubs, of the stack of the at least two monolithic devices with respect to an input element, another one of the rims or another one of the hubs, of said stack of at least (p×15°).

19. The drive member as claimed in claim 1, wherein the at least one elastic arm of each of the at least two monolithic devices is configured to exert a substantially constant elastic return moment over a range of angular displacement of the rim of said respective monolithic device with respect to the respective hub of at least 15°.

* * * * *